United States Patent [19]

Seitz et al.

[11] Patent Number: 4,524,976

[45] Date of Patent: Jun. 25, 1985

[54] MAGNETIC TARGET ASSEMBLY

[75] Inventors: Fred H. Seitz, Yorba Linda; Max J. Jaschke, Villa Park, both of Calif.

[73] Assignee: Air Cabin Engineering, Fullerton, Calif.

[21] Appl. No.: 560,986

[22] Filed: Dec. 13, 1983

[51] Int. Cl.[3] ..... F41J 7/04

[52] U.S. Cl. ..... 273/388; 273/391; 273/404

[58] Field of Search ..... 273/127 D, 388, 391, 273/392, 404

[56] References Cited

U.S. PATENT DOCUMENTS

| | | | |
|---|---|---|---|
| 910,608 | 1/1909 | Thompson | 273/391 |
| 996,712 | 7/1911 | Harper | 273/392 |
| 1,080,299 | 12/1913 | Richmond | 273/391 |
| 1,087,507 | 2/1914 | Palen | 273/391 |
| 2,957,694 | 10/1960 | Barber | 273/388 |
| 3,001,794 | 9/1961 | Alu | 273/41 |
| 3,411,784 | 11/1968 | Lawrence | 273/388 |
| 3,814,429 | 6/1974 | Lienhard | 273/392 |
| 3,844,559 | 10/1974 | Davidson | 273/388 |
| 3,845,957 | 11/1974 | Lohr . | |

*Primary Examiner*—Anton O. Oechsle

*Attorney, Agent, or Firm*—Fowler, Lambert & Hackler

[57] ABSTRACT

A remotely resettable target assembly includes an enclosure having a window therein and a number of individual targets pivotally-mounted within the enclosure for rotation from a set position to an unset position upon being struck by an incoming projectile. A master target is provided and coupled to a bar, including a plurality of permanent magnets for attracting the individual targets and holding them in an unset position. Upon striking of the master target, rotation of the bar including the pertinent magnets contained therein, causes separation of the permanent magnets from the individual targets, causing the individual targets to be reset by the force of gravity.

9 Claims, 3 Drawing Figures

MAGNETIC TARGET ASSEMBLY

The present invention is directed to target and trap assemblies and more particularly to portable target assemblies, suitable for home use with BB guns, air guns, and the like.

BACKGROUND

A great number of targets and traps for BB gun-type use have been available for some time.

A great number of these have non-destrubtible targets, which, upon being struck by a projectile, move to a position "out of view." In many of these types of devices, the shooter is required to advance to the target assembly in order to reset the targets to a visible position during the course of shooting.

This interruption greatly disturbs the concentration of the shooter.

Further, if more than one shooter is using the target assembly, there is always the possibility that one of the shooters may be struck inadvertently by another while he is approaching, or at the target, to reset it.

Hence, there is a need for a target assembly which is resettable by the shooter during the course of his shooting by striking one or more of the targets themselves.

It is to be appreciated that such targets, even for use with BB guns, must be rugged in order that repeated impact by the BB projectile do not cause malfunction of the targets by damaging the resetting mechanism therein.

A number of resettable targets have been developed, however, heretofore, these targets incorporated relatively elaborate mechanical linkages interconnecting individual targets and a master target which caused the release or resetting of the individual targets upon being struck by a projectile.

Complicated spring and linkage arrangements necessary for remotely setting the individual targets are undesirable for a number of reasons. First, because of the repeated impacts of projectiles glancing off the interior surfaces of a target/trap assembly, such springs and linkages may be broken or nicked, causing burrs thereon, which may thereafter cause malfunction of the remote resetting capability of the target/trap assembly. Second, such springs and linkages provide additional surfaces off which the projectiles may glance, or bounce, out of the target/trap assembly, thereby causing damage or injury to surrounding areas or persons.

As an example of such prior art, see U.S. Pat. No. 3,411,784 to Lawrence, dated Nov. 19, 1968. In this device a number of individual targets are suspended from a common rod and upon being struck by a projectile, swing upwardly until they strike and rest upon a support rod.

A master target is positioned to within the target assembly, such that when the master target is struck, a bar attached thereto pushes the individual targets off of the supporting rod and allows them to drop into a reset position.

It is immediately apparent from an examination of this device that the individual targets, as well as the linkages including the support rods and target arms, are in full view of the shooter when the targets are in an unset position. As hereinabove pointed out, these additional surfaces are exposed to incoming projectiles and may be dented thereby or deflect projectiles back out of the target assembly and into the area of the shooter.

If the linkages in the Lawrence device were covered with sheet metal or the like, to prevent exposure of the linkages to the incoming projectiles, the protective sheet metal would necessarily have to have an opening therein, through which the master target could be struck, in order to reset the individual targets.

Unfortunately, if this were done, there would be a large relatively flat perpendicular surface exposed to the shooter surrounding the master target from which projectiles would most likely bounce rearwardly into the area of the shooter, creating a potential for either injury or damage to the shooter, and the surrounding area, i.e., the target could not serve as a trap for the projectiles.

U.S. Pat. No. 3,844,559 to Davidson, dated Oct. 29, 1974, shows another approach to a remotely resettable target for small bore rifle practice which utilizes a central master target element and secondary target elements, all being pivoted on a common axis. In this instance, however, all of the targets are spring-loaded and the targets are resettable only with the use of cams and the like.

While such complex mechanical linkages may operate initially, there is a question as to the durability and longevity of the device because of its complex nature. Furthermore, the large number of parts necessary to assemble such a target impose an increased cost of production, which is undesirable in the competitive market of shooting accessories.

The present invention is directed to a target and a target/trap assembly which is durable, economical to produce, and simple an operation. Individual targets visible to the shooter when in a set position, are moved to an unset position, at which no portion of the target is in the view of shooter, i.e., neither the target or any arms linking the target to pivot positions are exposed after the target is moved to an unset position by a projectile. Hence, it is unlikely that the individual targets would be accidentally reset by an incoming projectile.

Additionally, the target assembly, in accordance with the present invention, may be utilized as a holder for a conventional-type paper target and provide a trap herebehind for catching projectiles passing through the paper-type target.

SUMMARY OF THE INVENTION

A remotely resettable target assembly, in accordance with the present invention, includes at least one target pivotally-mounted on a generally horizontal axis and suspended therefrom when the target is in a set position. The target is configured for a rotation to an unset position when struck by a projectile. A master target pivotally-mounted on a generally horizontal axis, is provided along with magnetic means disposed in an operative position for holding the target in an unset position after the target has been moved to its unset position. Magnetic means, in an operative relationship with the master target, is provided for releasing the target when the master target is struck by a projectile.

More particularly, a remotely resettable target assembly in accordance with the present invention, includes an enclosure having means defining a window opening in one side thereof and baffle means disposed within the enclosure for deflecting incoming projectiles passing through the window opening in a manner preventing such incoming projectiles from exiting the enclosure through the window opening.

A plurality of spaced apart individual targets pivotally-mounted within the enclosure, have a portion thereof visible through the window opening when the individual targets are in a set position and the individual targets are configured for rotation to an unset position when struck by an incoming projectile.

The targets have no portion thereof visible through the window opening when the individual targets are in the unset position. This feature makes it unlikely that any of the individual targets will be accidentally reset by an incoming projectile. The master target is pivotally-mounted within the enclosure and has a portion thereof visible through the window opening. The magnetic means includes a generally rectangular bar, having permanent magnet means therein aligned with each of the individual targets for attracting and holding each individual target in an unset position.

Fixed to the master target and mounted within the enclosure, the rectangular bar pivots therewith when the master target is struck by a projectile. Pivoting of the rectangular bar causes separation of the magnetic means from the individual targets, enabling each individual target to return to a set position by the force of gravity.

A plurality of individual permanent magnets are imbedded in the rectangular bar with each of the permanent magnets aligned with an associated individual target for attracting and holding the associated individual target in an unset position.

BRIEF DESCRIPTION OF THE DRAWINGS

The advantages and features of the present invention will be better understood by the following description and drawings, in which.

DETAILED DESCRIPTION

Figure 1:
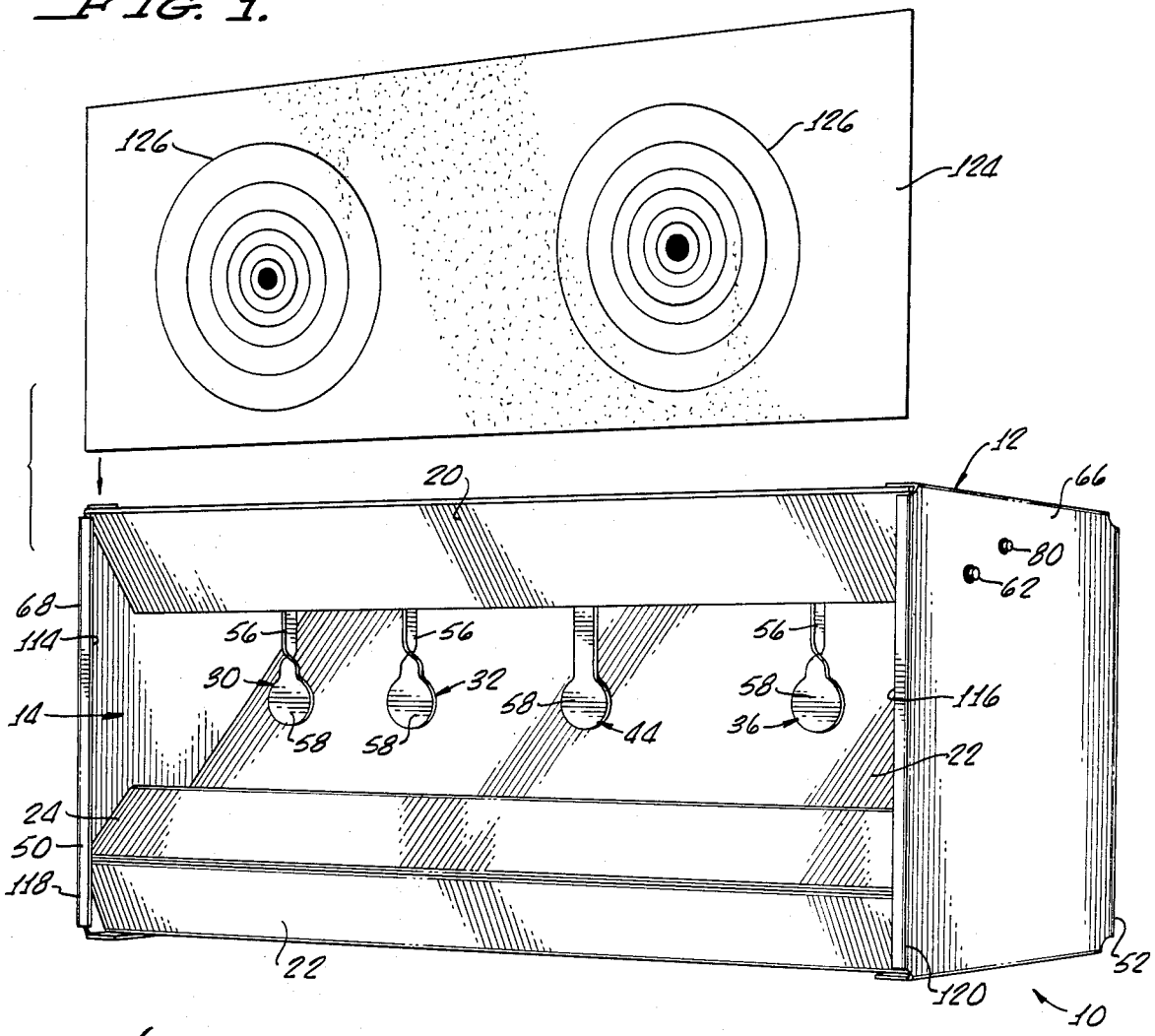
FIG. 1 is a perspective view of the target assembly in accordance with the present invention, showing a plurality of individual targets and a centrally located master target, some of the targets being in an unset position and, therefore, having no part thereof visible through the window opening of the target assembly. Also shown is a conventional paper-type target in a position over the target assembly ready for insertion in supporting brackets on the front of the target assembly for supporting the paper-like target in front of the movable targets and the window opening.
Figure 3:
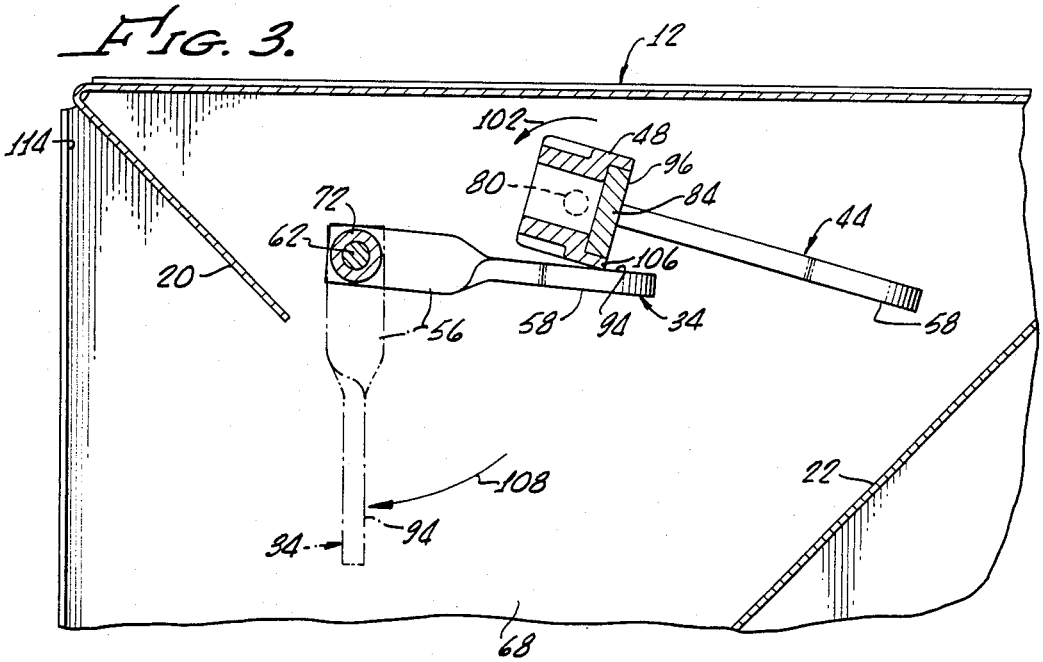
Figure 2:
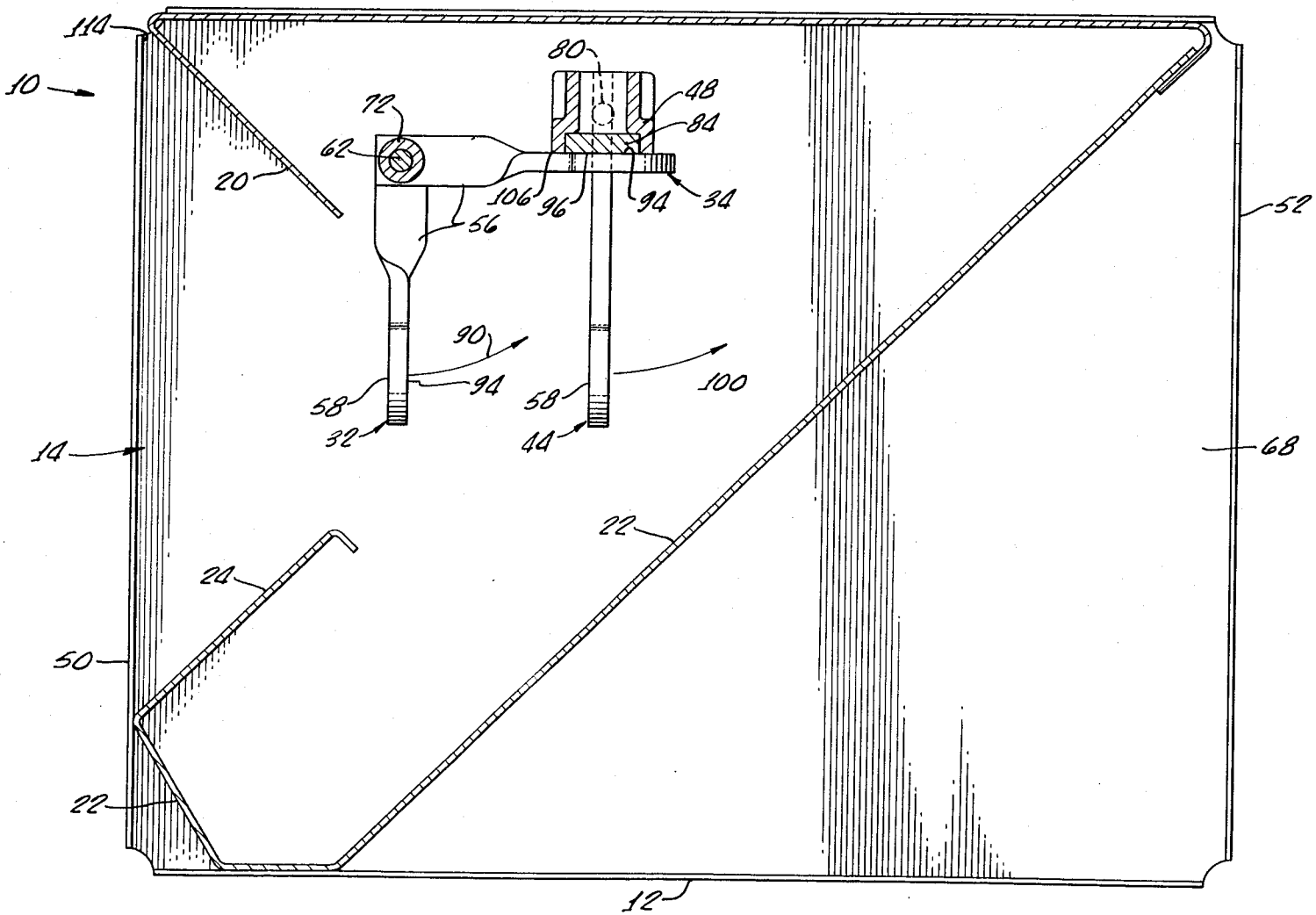
FIG. 2 is a cross-sectional side view of the target assembly in accordance with the present invention showing the relative positions of the individual and master target, with one of the targets being shown in an unset position and held in such position by magnets disposed in a rectangular bar attached to the master target; and, FIG. 3 is a second cross-sectional view of the target assembly in accordance with the present invention, similar to FIG. 2 showing movement of the master target upon being struck, causing separation of the magnets in the rectangular bar from the individual targets and enabling each individual target to return to a set position by the force of gravity.

Referring now to FIG. 1, a remotely resettable target assembly 10 in accordance with the present invention, generally includes an enclosure 12 formed from a suitable material, such as sheet metal, having a window opening 14 therein, deflectors, 20, 22, 24, providing a baffle means for deflecting incoming projectiles passing through the window opening 14, a plurality of spaced apart individual targets 30, 32, 34, 36, a master target 44, and a bar 48 (see FIGS. 2 and 3) disposed within the enclosure 12 in an operative position for providing means to hold individual targets 30, 32, 34, 36 in an unset position after each individual target has been moved to an unset position by an incoming projectile, not shown.

More particularly, the deflectors 20 and 24 may be formed of sheet metal and attached to, or integrally formed from the same sheet of metal forming the enclosure 12, and aligned at angles for deflecting incoming projectiles striking the deflectors 20, 24 into the enclosure 12.

The deflector, or baffle, 22 is attached to the interior of the enclosure near a front 50 thereof and the back 52 thereof at an angle for deflecting projectiles striking thereupon to richochet thereoff at angles preventing the escape of the projectiles from the enclosure through the window opening 14. The position of the deflectors 20, 22, 24 at angles to prevent escape of projectiles from the enclosure 14, is well known in the art.

Each of the individual targets 30, 32, 34, 36 are formed from a flat stock of magnetic material and have a twisted arm portion 56 and a generally circular target portion 58, which is visible through the window opening 14 when the individual targets are in a set position.

As shown, the target portion 58 is of generally circular shape, having a diameter of approximately $\frac{3}{4}''$. It should be appreciated that any shape target portion may be used for the entertainment of the shooter, such as animals or the like.

Each of the individual targets 30, 32, 34, 36 are pivotally-mounted within the enclosure all along a common axis or rod 62 and are spaced apart from one another and sides 66, 68 of the enclosure 12 by means of sleeves 72.

The master target is fixed to the bar 48, which is comprised of a non-magnetic material and pivotally-mounted therewith between the sides 66, 68 of the enclosure 12 by means of pins 80 protruding through the sides 66, 68. The bar 48, which may be formed of any suitable non-magnetic material, such as plastic, has a plurality of permanent magnets 84 disposed therein. All of the individual targets 30, 32, 34, 36 and the master target 44, are mounted in a spaced apart relationship, in order to cause the magnets 84 to be aligned with each of the individual targets for attracting and holding the individual targets in an unset position when they are moved to such unset positions by incoming projectiles.

It should be appreciated that, while the magnets 84 are shown being disposed in the bar 48 for attracting the magnetic individual targets 30, 32, 34, 36, alternatively, individual magnets may be placed on each individual target and the bar 48 may be formed from the magnetic material.

In a target for use with BB guns, the target portion 58 of the individual targets 30, 32, 34, 36, as well as the target portion 58 of the master target 44, may be about $\frac{3}{4}''$ in diameter and have an arm length of about one (1) inch. For this configuration, it has been found that the individual magnets should have approximately $3\frac{1}{2}$ pound pull attraction to the individual targets in order to attract and hold the individual targets in an unset position after being struck by a projectile without bouncing of the individual target off of the bar 48 before the magnetic field of the magnetic 84 can hold a target thereto.

It should also be appreciated that the size of these magnets will be determined by experimentation and is dependent upon the size of the individual target portion, the length of the arms 56, the weight of the individual targets and the expected impact from an incoming projectile.

In operation, as a projectile strikes one of the targets 30, 32, 34, 36, it swings upwardly in the direction of Arrow 90, until the target portion 58 starts or approaches the magnet 84. At this time, the magnetic attraction holds the target in an unset position, and because of the position of the deflector 20, no portion of the individual targets 30, 32, 34, 36, are visible through the window opening 14 when the targets are held to the rectangular bar 48 by the magnets 84, as the targets assume an unset position.

To maximize the magnetic attraction between the magnet and the target portion 58, the rod 62 is disposed lower than the pins 80, thereby enabling the targets to rotate to an unset position, in which a back face 94 of the target portion of 58 is approximately parallel with a face 96 of the magnets 84. Additionally, at this configuration, enables a decoupling of the magnet 84 from the target portion 58 upon rotation of the master target 44.

To reset the targets, a shooter strikes a master target with a projectile, causing it to rotate rearwardly in the direction of Arrow 100. This rotation causes the rectangular bar 48 to similarly rotate about the pins 80, as shown by the Arrow 102, causing a corner thereof 106 to push downwardly against the back face 94 of the target portion 58, thereby causing a separation between the magnet 84 and the back face 94 as most clearly shown in FIG. 3. This separation reduces the magnetic attraction of the target portion 58 to the magnet 84, thereby enabling the force of gravity to rotate the targets 30, 32, 34, 36, 38, into a set position, shown by Arrow 108, the master target returning to an equilibrium suspended position, thereafter by the force of gravity.

Yet another feature of the target assembly, in accordance with the present invention, is the use of a conventional paper-like target 124 therewith, having concentric circles 126, suitable for the "sighting"0 and adjustment of rifles. A pair of slots or grooves 114, 116 along the front edges 118, 120 of the enclosure 12 enable the paper-type target 124 to be supported between covering the window opening 14 while still providing a trap for projectiles passing through the paper target. The paper targets may have conventional circles 126 drawn therein for use in calibrating the sights of air rifles and the like.

Although there has been described here and above a specific arrangement of a resettable target assembly, in accordance with the present invention for purposes of illustrating the manner in which the invention may be used to advantage, it will be appreciated that the invention is not limited thereto. Accordingly, any and all modifications, variations, or equivalent arrangements which may occur to those skilled in the art, should be considered within the scope of the invention as defined in the appended claims.

What is claimed is:

1. A remotely resettable target assembly comprising:

a plurality of spaced apart individual targets pivotally mounted on a generally horizontal axis and suspended therefrom when the individual targets is in a set position, said individual targets being configured for rotation to an unset position when struck by a projectile;

a master target pivotally mounted on a generally horizontal axis; and magnetic means disposed in an operative position for holding each individual target in an unset position after said individual target has been moved to an unset position, said magnetic means being in an operative relationship with said master target for releasing each individual target when said master target is struck by a projectile.

2. The resettable target assembly of claim 1 wherein the magnetic means includes a generally rectangular bar having permanent magnetic means therein aligned with each of said individual targets for attaching and holding each individual target in an unset position, said rectangular bar being fixed to said master target and mounted for pivoting therewith when the master target is struck by a projectile, pivoting of said rectangular bar causing separation of the magnetic means from the individual targets, enabling each individual target to return to a set position by the force of gravity.

3. The resettable target assembly of claim 2 wherein the rectangular bar is formed from a non-magnetic material and said permanent magnet means includes a plurality of individual permanent magnets imbedded in said rectangular bar, each permanent magnet being aligned with an associated individual target for attracting and holding the associate individual target in an unset position.

4. The resettable target assembly of claim 3 wherein said individual targets are pivotally-mounted on a common axis.

5. A remotely resettable target assembly comprising:

an enclosure having means defining a window opening in one side thereof, baffle means disposed within said enclosure for deflecting incoming projectile passing through said window opening in a manner preventing said incoming projectile from exiting said enclosure through said window opening;

a plurality of spaced apart individual targets pivotally mounted within said enclosure and having a portion thereof visible through said window opening when the individual targets are in a set position, said individual targets being configured for rotation to an unset position when struck by an incoming projectile, said target having no portion thereof visible through said window opening when the individual targets are in the unset position; and, a master target pivotally mounted within said enclosure and having a portion thereof visible through said window opening;

magnetic means disposed within said enclosure in an operative position for holding said individual targets in an unset position after each individual targets have been moved to an unset position, said magnetic means being in an operative relationship with said master target for releasing said individual targets when said master target is struck by an incoming projectile.

6. The resettable target assembly of claim 5 wherein the magnetic means includes a generally rectangular bar having permanent magnet means therein aligned with each of said individual targets for attaching and holding each individual target in an unset position, said rectangular bar being fixed to said master target and mounted within said enclosure for pivoting therewith when the master target is struck by a projectile, pivoting of said rectangular bar causing separation of the magnet means from the individual targets enabling each individual target to return to a set position by the force of gravity.

7. The resettable target assembly of claim 6 wherein the rectangular bar is formed from a non-magnetic material and said permanent magnet means includes a plurality of individual permanent magnets imbedded in said rectangular bar, each permanent magnet being aligned with an associated individual target for attracting and holding the associated individual target in an unset position.

8. The resettable target assembly of claim 7 wherein said individual targets are pivotally mounted on a common axis.

9. The resettable target assembly of claim 8 wherein the enclosure further includes means for supporting a paper-like target in front of said window opening.

* * * * *